US006220918B1

(12) United States Patent
Laronge

(10) Patent No.: US 6,220,918 B1
(45) Date of Patent: Apr. 24, 2001

(54) TOSSABLE RING AIRFOIL PROJECTILE

(75) Inventor: Ronald V. Laronge, San Jose, CA (US)

(73) Assignee: OddzOn, Inc., Pawtucket, RI (US)

( * ) Notice: Subject to any disclaimer, the term of this patent is extended or adjusted under 35 U.S.C. 154(b) by 0 days.

(21) Appl. No.: 09/610,921

(22) Filed: Jul. 6, 2000

Related U.S. Application Data

(63) Continuation of application No. 09/097,227, filed on Jun. 12, 1998, now abandoned.

(51) Int. Cl.[7] ..... A63H 27/14

(52) U.S. Cl. ..... 446/63; 446/46; 446/255; 473/585; 244/3.24

(58) Field of Search ..... 446/46, 48, 61, 446/63, 64, 67, 71, 255; 473/579, 580, 585, 586; 244/3.24, 3.3, 35 R, 36, 39, 198; D21/387

(56) References Cited

U.S. PATENT DOCUMENTS

| | | |
|---|---|---|
| 23,538 | 4/1859 | Arnold . |
| 186,255 | 1/1877 | Jenkins . |
| D. 279,492 | 7/1985 | Eddins et al. . |
| D. 288,216 | 2/1987 | Jensen . |
| D. 306,894 | 3/1990 | DeMarco . |
| D. 337,796 | 7/1993 | Sutyak . |
| D. 346,001 | 4/1994 | Stillinger et al. . |
| D. 348,907 | 7/1994 | Prentice et al. . |
| D. 350,577 | 9/1994 | Giudice . |
| D. 355,460 | 2/1995 | Routzong et al. . |
| D. 361,811 | 8/1995 | Grimm et al. . |
| 1,293,869 | 2/1919 | Murray et al. . |
| 1,296,403 | 3/1919 | Kindle . |
| 1,520,131 | 12/1924 | Jacob . |
| 1,718,508 | 6/1929 | White . |
| 1,976,065 | 10/1934 | Forkner . |
| 2,173,382 | 9/1939 | West . |
| 2,183,152 | 12/1939 | Prensky et al. . |
| 2,338,719 | 1/1944 | Holt . |
| 2,432,209 | 12/1947 | Osgood . |
| 2,494,026 | 1/1950 | Anderson . |
| 2,608,027 | 8/1952 | Perker et al. . |
| 2,611,999 | 9/1952 | Mikolay . |
| 2,691,495 | 10/1954 | Chiroky . |
| 2,759,297 | 8/1956 | Lewis . |
| 2,763,958 | 9/1956 | Lemelson . |
| 2,784,711 | 3/1957 | Vaughn . |

(List continued on next page.)

FOREIGN PATENT DOCUMENTS

| | | |
|---|---|---|
| 900310 | 7/1949 | (DE) . |
| 469863 | 9/1937 | (GB) . |

OTHER PUBLICATIONS

Barr Rubber Products Co. 1965 Athletic Ball Catalog.
Parker Brothers Catalog, 1991.

*Primary Examiner*—Kien T. Nguyen
(74) *Attorney, Agent, or Firm*—Marshall, O'Toole, Gerstein, Murray & Borun

(57) ABSTRACT

Tossable ring airfoil projectiles configured to adopt and maintain a flying orientation that generates lift. The tossable ring airfoil projectiles generally include (i) a ring airfoil having a trailing end, an aperture, and a longitudinal symmetry axis running through the aperture, and (ii) a tail associated with the ring airfoil and extending rearward beyond the trailing end. The ring airfoil provides lift that allows the tossable ring airfoil projectile to follow a flying trajectory. The tail stabilizes the projectile during flight and may provide a torque that biases the ring airfoil toward preferred flying orientations. The tail may extend along the longitudinal symmetry axis and may include outwardly extending fins. The tossable ring airfoil projectile further may include a connection configured to associate the tail with the ring airfoil. The connection also may extend along the longitudinal symmetry axis and may include outwardly extending flanges.

21 Claims, 1 Drawing Sheet

U.S. PATENT DOCUMENTS

| | | |
|---|---|---|
| 2,870,570 | 1/1959 | Benson . |
| 3,147,011 | 9/1964 | Lemelson . |
| 3,190,654 | 6/1965 | Ross . |
| 3,198,526 | 8/1965 | Smith et al. . |
| 3,225,488 | 12/1965 | Goldfarb . |
| 3,232,285 | 2/1966 | Rasner . |
| 3,256,020 | 6/1966 | Smith . |
| 3,264,776 | 8/1966 | Morrow . |
| 3,292,879 | 12/1966 | Chilowsky . |
| 3,373,730 | 3/1968 | Jenison . |
| 3,437,340 | 4/1969 | Grise . |
| 3,528,662 | 9/1970 | Merchant et al. . |
| 3,746,334 | 7/1973 | Stubblefield . |
| 3,877,383 | 4/1975 | Flatau . |
| 3,898,932 | 8/1975 | Flatau et al. . |
| 3,909,976 | 10/1975 | Kirk . |
| 3,951,070 | 4/1976 | Flatau et al. . |
| 3,982,489 | 9/1976 | Flatau et al. . |
| 4,003,574 | 1/1977 | MacDonald et al. . |
| 4,021,041 | 5/1977 | Goldfarb et al. . |
| 4,088,319 | 5/1978 | Clarke . |
| 4,109,411 | 8/1978 | Wetherell et al. . |
| 4,112,613 | 9/1978 | Toplak . |
| 4,151,674 | 5/1979 | Klahn et al. . |
| 4,154,012 | 5/1979 | Miller . |
| 4,246,721 | 1/1981 | Bowers . |
| 4,262,911 | 4/1981 | Opresik et al. . |
| 4,291,663 | 9/1981 | Buck et al. . |
| 4,294,447 | 10/1981 | Clark . |
| 4,335,537 | 6/1982 | Walker . |
| 4,339,138 | 7/1982 | De Manno . |
| 4,366,936 | 1/1983 | Ferguson . |
| 4,390,148 | 6/1983 | Cudmore . |
| 4,519,613 | 5/1985 | Martin . |
| 4,531,737 | 7/1985 | Jacobson et al. . |
| 4,537,405 | 8/1985 | Cymbler . |
| 4,657,253 | 4/1987 | Lerner et al. . |
| 4,736,948 | 4/1988 | Thomas . |
| 4,737,128 | 4/1988 | Moormann et al. . |
| 4,790,788 | 12/1988 | Hill . |
| 4,930,777 | 6/1990 | Holenstein . |
| 4,943,066 | 7/1990 | Lathim et al. . |
| 4,957,092 | 9/1990 | Rhodes . |
| 5,000,451 | 3/1991 | MacDonald et al. . |
| 5,045,011 | 9/1991 | Lovik . |
| 5,066,017 | 11/1991 | Kurland . |
| 5,067,922 | 11/1991 | McMahon . |
| 5,123,645 | 6/1992 | MacDonald et al. . |
| 5,152,709 | 10/1992 | Johnson . |
| 5,171,021 | 12/1992 | Orak . |
| 5,224,464 | 7/1993 | Burnham et al. . |
| 5,228,690 | 7/1993 | Rudell et al. . |
| 5,267,735 | 12/1993 | Bushman . |
| 5,269,514 | 12/1993 | Adler et al. . |
| 5,284,341 | 2/1994 | Routzong et al. . |
| 5,306,191 | 4/1994 | Phillips . |
| 5,397,261 | 3/1995 | Malewicki et al. . |
| 5,438,972 | 8/1995 | Harbin . |
| 5,458,329 | 10/1995 | Bushman et al. . |
| 5,460,368 | 10/1995 | Pearson . |
| 5,577,732 | 11/1996 | Spector . |
| 5,807,198 | 9/1998 | Grimm . |

TOSSABLE RING AIRFOIL PROJECTILE

This is a continuation of U.S. application Ser. No. 09/097,727 filed Jun. 12, 1998 now abandoned.

TECHNICAL FIELD

This invention relates generally to ring airfoils. More particularly, this invention relates to tossable ring airfoil projectiles configured to adopt and maintain a flying orientation that generates lift. This lift causes the tossable ring airfoil projectiles to follow a nearly level trajectory having a longer flight time than characterizes standard ballistic motion.

BACKGROUND OF THE INVENTION

Flying toys are popular amusement devices that include boomerangs, flying discs, kites, model airplanes, and ring airfoils. The popularity of flying toys arises in part because flying toys generate lift as they move through the air, giving them interesting and engaging flight characteristics.

Ring airfoils are relatively obscure flying toys that generally resemble hollow cylinders having open ends. The walls of these cylinders may have an airfoil shape. Ring airfoils "fly" when they generate lift by moving through the air in a flying orientation. Lift generated in flying orientations, combined with low aerodynamic drag, causes ring airfoils to follow nearly level trajectories. In contrast, nonflying toys, such as balls, follow parabolic ballistic trajectories. Nearly level trajectories ensure greater flight times than ballistic trajectories, enhancing the fun of playing with ring airfoils.

In a preferred flying orientation, a leading end of the ring airfoil points generally forward, in the direction of motion, and a trailing end points generally backward, away from the direction of motion. This orientation may be gyro-stabilized by imparting spin to the ring airfoil about a longitudinal symmetry axis connecting the leading and trailing ends.

Although known for many years, ring airfoils have failed to achieve the popularity of other flying toys. This failure may be due in part to difficulties inherent in inducing ring airfoils to move through the air in a flying orientation. In particular, because ring airfoils generally are launched by hand, they typically do not begin their trajectory in a flying orientation. Moreover, even if ring airfoils do begin their trajectory in a flying orientation, they typically do not have sufficient spin to gyro-stabilize that orientation, leaving them susceptible to pitching, yawing, wobbling, and/or tumbling during flight. The skill level necessary to overcome these difficulties effectively may place the use of ring airfoils outside the ability of casual players, or of children in general.

Previous attempts to improve the flight characteristics of ring airfoils have included adjusting the dimensions and mass distribution of the ring airfoils to improve lift. Yet, such improved lift cannot be exploited fully unless the ring airfoil is in a flying Orientation.

SUMMARY OF THE INVENTION

The invention addresses these and other shortcomings by providing tossable ring airfoil projectiles configured to adopt and maintain a flying orientation. The tossable ring airfoil projectiles generally include (i) a ring airfoil having a trailing end, an aperture, and a longitudinal symmetry axis running through the aperture, and (ii) a tail associated with the ring airfoil and extending rearward beyond the trailing end.

The ring airfoil is substantially symmetric about the longitudinal symmetry axis and provides lift that allows the tossable ring airfoil projectile to follow a flying trajectory. The ring airfoil may be formed of a variety of materials, including deformable materials, and may be configured to be held in a hand.

The tail stabilizes the tossable ring airfoil projectile during flight and may provide a torque that biases the ring airfoil toward a flying orientation. The tail may be formed of a variety of materials, including deformable materials, and may extend substantially parallel to or along the longitudinal symmetry axis. The tail may have various geometries and dimensions. It may be symmetric, it may include at least one fin extending outward from the longitudinal symmetry axis, and it may be substantially at least as long as the ring airfoil. The tail may be movable or may have a substantially fixed orientation relative to the ring airfoil.

The tail may be associated with the ring airfoil in various ways. For example, the tail may be associated with the ring airfoil by a connection to the trailing end. Alternatively, the ring airfoil may have an inner surface, and the tail may be associated with the ring airfoil by a connection to the inner surface. The connection may include a plurality of flanges and a structure configured to join the flanges to the trailing end and/or inner surface. These flanges may be aligned with fins in the tail.

The nature of the invention will be understood more readily after consideration of the drawings and the detailed description of the preferred embodiment that follow.

DETAILED DESCRIPTION OF THE PREFERRED EMBODIMENT AND BEST MODE OF CARRYING OUT THE INVENTION

Figure 1:
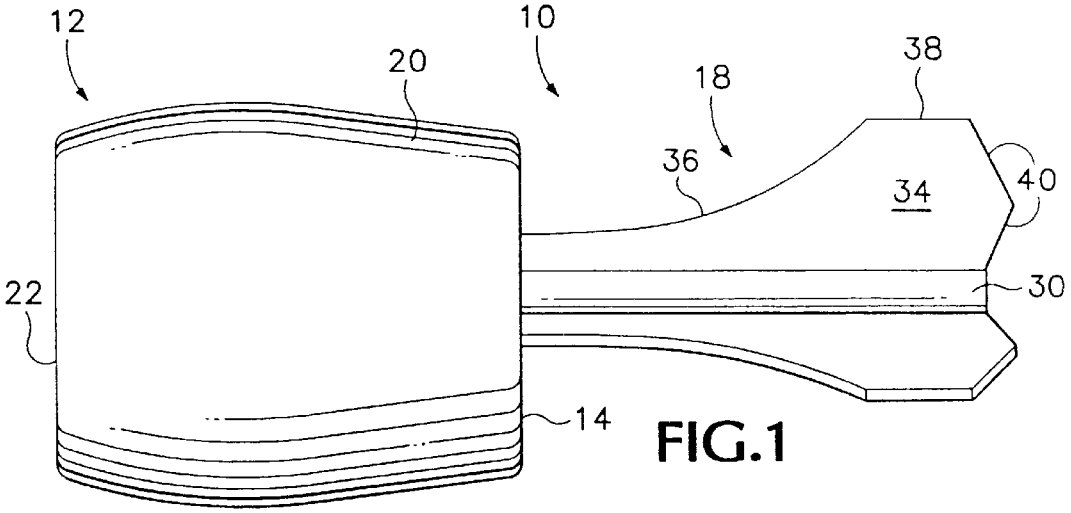
FIG. 1 is a side elevation view of a tossable ring airfoil projectile constructed in accordance with the invention.
Figure 2:
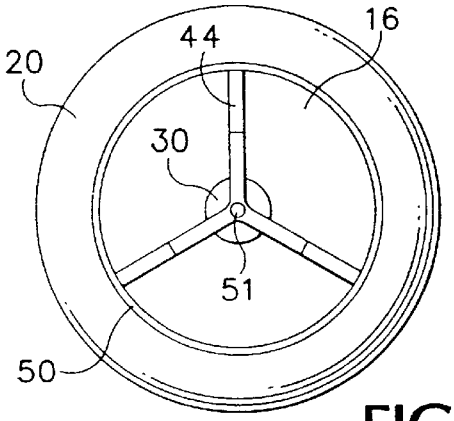
FIG. 2 is a front elevation view of the tossable ring airfoil projectile shown in FIG. 1.
Figure 3:
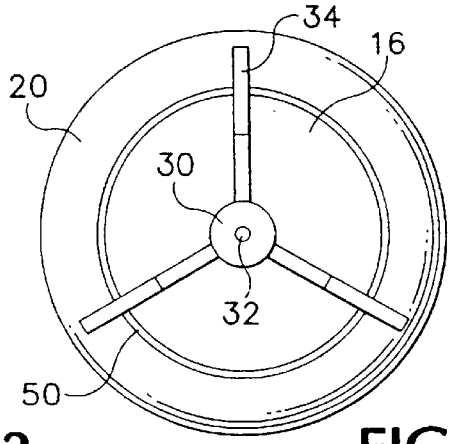
FIG. 3 is a rear elevation view of the tossable ring airfoil projectile shown in FIG. 1.
Figure 4:
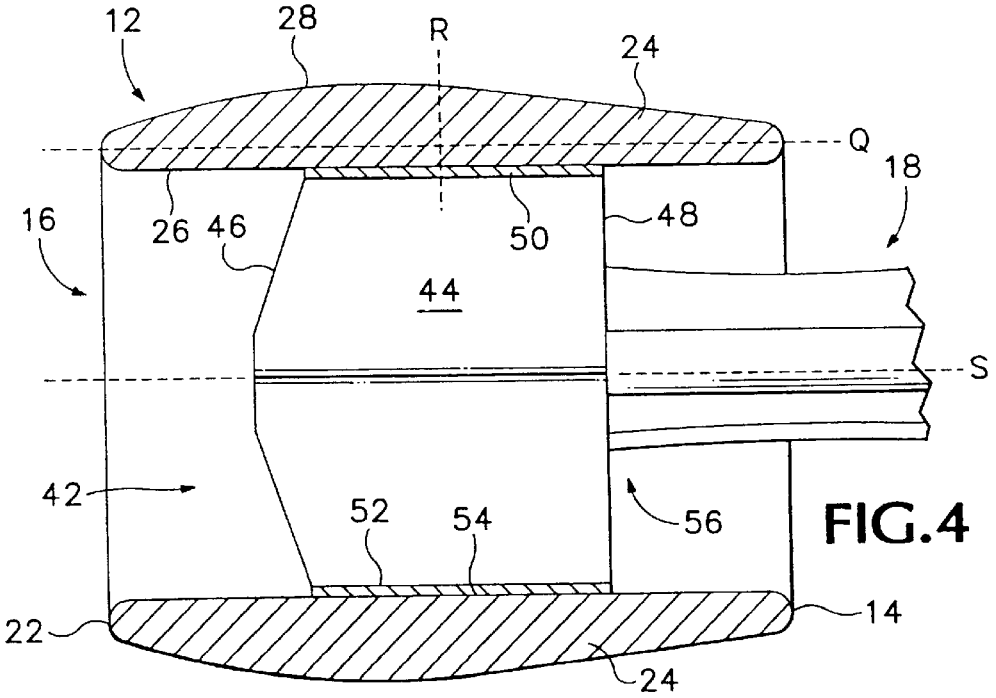
FIG. 4 is a breakaway partially cross-sectional view of the ring airfoil shown in FIG. 2.

FIGS. 1–4 show an embodiment of a tossable ring airfoil projectile 10 .constructed in accordance with the invention. Generally, the invention includes (i) a ring airfoil 12 having a trailing end 14, an aperture 16, and a longitudinal symmetry axis S running through aperture 16, and (ii) a tail 18 associated with ring airfoil 12 and extending rearward beyond trailing end 14.

Ring airfoil.

The ring airfoil provides lift that allows the tossable ring airfoil projectile to follow a flying trajectory. The ring airfoil may take a variety of forms, but generally resembles a hollow cylinder open at both ends and substantially symmetric about longitudinal symmetry axis S. Ring airfoil 12 includes a hollow, annular body 20 having an aperture 16, leading and trailing ends 22, 14, and a wall 24 with inner and outer surfaces 26, 28. Aperture 16 may vary in diameter, but typically will be substantially at least one-half the diameter of body 20.

Walls 24 of ring airfoil 12 may have an airfoil cross section, like that of an airplane's wing. This cross section may be asymmetric about a longitudinal centerline Q bisecting leading and trailing ends 22, 14. Moreover, this cross section also may be asymmetric about a transverse centerline R bisecting inner and outer surfaces 26, 28. Whether symmetric or asymmetric, ring airfoil 12 has an inherently rounded shape that enhances its safety as a tossable projectile.

Particular properties of ring airfoil 12 may be determined by safety considerations. For example, ring airfoil 12 may be formed of a lightweight, deformable material, such as foam, to reduce impact hazards to humans, objects, and the ring airfoil itself. Similarly, ring airfoil 12 may be dimensioned larger than a human eye socket to reduce the likelihood of substantial impact with a human eyeball. In a preferred embodiment, ring airfoil 12 is about 4 inches in length and about 3.5 inches in diameter.

Particular properties of ring airfoil 12 also may be determined by functional considerations. For example, ring airfoil 12 may be configured to be held in a hand by including shallow indentations on outer surface 28 for receiving fingertips, or by being dimensioned to grip comfortably in a hand.

Tail.

The tail stabilizes the tossable ring airfoil projectile during flight and may take a variety of forms. Tail 18 includes a central cylindrical portion 30 extending rearward from trailing end 14 along longitudinal symmetry axis S. A central tail aperture 32 runs the entire length of cylindrical portion 30. In alternative embodiments, the tail may be solid and may extend parallel or at an angle to longitudinal symmetry axis S, rather than along it. Tail 18 also includes three generally planar, outwardly extending fins 34 attached at equal angles to central cylindrical portion 30 along substantially its entire length. Fins 34 include a curved leading edge 36 and straight outer and trailing edges 38, 40. In alternative embodiments, the tail may have no fins, a different number of fins, or differently shaped fins. Tail 18 is substantially symmetric about longitudinal symmetry axis S. In a preferred embodiment, tail 18 is about 5 inches in length, or substantially at least as long as ring airfoil 12. In alternative embodiments, the tail may be asymmetric and/or may be shorter or longer than ring airfoil 12. Tail 18 has a substantially fixed orientation relative to the ring airfoil. In alternative embodiments, the tail may be movable relative to the ring airfoil. For example, the ring airfoil may be able to spin around longitudinal symmetry axis S while the tail does not.

Particular properties of tail 18 may be determined by safety and/or functional considerations. For example, tail 18 may be formed of a deformable material to reduce impact hazards. Tail 18 also may be configured to stabilize the projectile during flight.

Connection.

The tail may be associated with the ring airfoil in various ways. For Example, tail 18 is associated with ring airfoil 12 by a connection 42 to inner surface 26. Connection 42 includes three generally planar, outwardly extending flanges 44 having leading and trailing flange edges 46, 48. Flanges 44 are attached to one another at 120° angles along longitudinal symmetry axis S. A central connection aperture 51 runs the entire length of connection 42 and meets with central tail aperture 32. Connection 42 also includes a cylinder 50 having inner and outer cylinder surfaces 52, 54.

Connection 42 functions as follows. A leading end 56 of tail 18 is joined to flanges 44 at trailing flange edges 48, so that flanges 44 are aligned with fins 34. In turn, flanges 44 are joined to cylinder 50 at inner cylinder surface 52. Finally, cylinder 50 is joined to ring airfoil 12 at inner surface 26. These pieces may be joined by suitable adhesive means, such as glue, or they may be formed as single unitary elements.

In alternative embodiments, connection 42 may have no flanges, a different number of flanges, or differently shaped flanges. Alternatively, tail 18 and ring airfoil 12 may be formed as a unitary structure without a connection. Alternatively, tail 18 may be associated with ring airfoil 12 by a connection to trailing end 14.

Methods of Use.

Tossable ring airfoil projectile 10 may be used to play catch or may be launched for accuracy and/or distance, among other applications. For example, launching for accuracy might involve trying to hit a target. Launching for distance might involve trying to travel a long distance by optimizing the launch angle. Maximum range generally is obtained at a smaller launch angle for a tossable ring airfoil projectile than for a nonflying projectile.

Tossable ring airfoil projectile 10 is launched as follows. A direction of flight is selected, ring airfoil 12 is grasped in a hand with tail 18 extending away from the direction of flight, the hand grasping ring airfoil 12 is moved in the direction of flight, and ring airfoil 12 is released. The hand may be moved so that tossable ring airfoil projectile 10 spins about longitudinal symmetry axis S in addition to moving forward, thereby gyro-stabilizing the projectile and helping it to maintain lift.

If tossable ring airfoil projectile 10 is launched in certain orientations, it will "fly" along a nearly level trajectory rather than fall along a parabolic ballistic trajectory. This flight characteristic is a consequence of lift generated by air moving over the surfaces of the ring airfoil in a way that reduces air pressure on upper surfaces and/or increases air pressure on lower surfaces of the ring airfoil. In a preferred flying orientation, leading end 22 of ring airfoil 12 points generally forward, in the direction of motion, and trailing end 14 points generally backward, away from the direction of motion. In addition, leading end 22 may tilt upward slightly relative to trailing end 14, such that longitudinal symmetry axis S through ring airfoil 12 makes a small angle relative to the horizontal. This angle will remain largely unchanged throughout the ring airfoil's trajectory.

Tail 18 helps tossable ring airfoil projectile 10 adopt and maintain a flying orientation. In the preferred flying orientation, tail 18 trails ring airfoil 12, presenting a minimum surface area in the direction of travel. If tossable ring airfoil projectile 10 pitches or yaws, tail 18 will present a larger surface area to the air. Air hitting this larger surface area will create a torque on the projectile that biases it back into the preferred flying orientation.

The nearly level trajectories followed by flying tossable ring airfoil projectiles are characterized by longer flight times than characterize standard ballistic trajectories, enhancing the fun of playing with ring airfoils. For example, the flight time t associated with an initially horizontal ballistic trajectory is given by the expression $t=[2\ h/g]^{1/2}$, where h is the vertical distance through which the projectile falls before impact, and g is the acceleration due to gravity, or approximately 9.8 meters per second squared. The flight time for a nonflying projectile launched horizontally from a height of about 1.2 meters (4 feet) will be about 0.50 seconds, according to this formula. The flight time for a tossable ring airfoil projectile launched horizontally from the same height will be at least this long, because lift forces effectively will reduce g in the above expression for flight time.

Accordingly, while the invention has been disclosed in its preferred form, the specific embodiment thereof as disclosed and illustrated herein is not to be considered in a limiting sense, because numerous variations are possible and no single feature, function, or property of the preferred embodiment is essential. The invention is to be defined only by the scope of the issued claims.

I claim:

1. A throwing toy, comprising:

a ring airfoil that is rotationally symmetric to facilitate spinning of said ring airfoil when said ring airfoil is thrown by a person, said ring airfoil comprising:

an annular body having a central axis and a diameter, said annular body being rotationally symmetric about said central axis, said annular body having a leading end, a trailing end spaced apart from said leading end in a direction parallel to said central axis, a smooth, non-planar annular outer surface, and a smooth annular inner surface, said annular body having a first thickness at a point adjacent said leading end, a second thickness at a point adjacent said trailing end, and a third thickness at a point disposed between said leading end and said trailing end, said third thickness being greater than each of said first and second thicknesses, said annular body having a length corresponding to the distance between said leading end and said trailing end in a direction parallel to said central axis, said length of said annular body being at least as large as the width of a person's hand to allow a person to grip said annular body by the hand to throw said annular body, said annular inner surface having a diameter;

a front circular opening formed in said annular body, said front circular opening being formed at said leading end of said annular body, said front circular opening having a center that is located on said central axis of said annular body;

a rear circular opening formed in said annular body, said rear circular opening being formed at said trailing end of said annular body, said rear circular opening having a center that is located on said central axis; and a central passageway formed through said annular body, said central passageway having a central axis that is coincident with said central axis of said annular body, said central passageway interconnecting said front circular opening and said rear circular opening so that, when said annular body is thrown through the air, air flowing into said front circular opening passes through said central passageway and exits said central passageway through said rear circular opening, said central passageway having a diameter that is at least one-half of said diameter of said annular body of said ring airfoil;

an elongate tail portion coupled to said ring airfoil, said elongate tail portion having a leading end and a trailing end and a length corresponding to the distance between said leading end of said elongate tail portion and said trailing end of said elongate tail portion in a direction parallel to said central axis of said annular body, said length of said elongate tail portion being about at least as great as said length of said annular body of said ring airfoil;

at least three fins coupled to said elongate tail portion, said fins being spaced radially around said tail portion, each of said fins extending outwardly from said tail portion and having a thickness that is less than said third thickness of said annular body of said ring airfoil, at least a portion of each of said fins extending behind said annular body of said ring airfoil and outside of said central passageway; and a connecting structure that interconnects said elongate tail portion and said ring airfoil, at least a portion of said connecting structure being disposed within said central passageway of said annular body of said ring airfoil, said connecting structure comprising:

an annular body having a front end, a back end, an outer annular surface and an inner annular surface, said outer annular surface of said annular body of said connecting structure having a diameter that corresponds to said diameter of said inner surface of said annular body of said ring airfoil, said annular body of said connecting structure having a thickness that is less than said third thickness of said annular body of said ring airfoil, said annular body of said connecting structure having a length corresponding to the distance between said front end of said annular body of said connecting structure and said back end of said annular body of said connecting structure in a direction parallel to said central axis, said length of said annular body of said connecting structure being smaller than said length of said annular body of said ring airfoil;

a first connecting member having a first end coupled to said annular body of said connecting structure and a second end spaced from said annular body of said connecting structure, said first connecting member having a thickness that is less than said third thickness of said annular body of said ring airfoil;

a second connecting member having a first end coupled to said annular body of said connecting structure and a second end spaced from said annular body of said connecting structure, said second connecting member having a thickness that is less than said third thickness of said annular body of said ring airfoil, said second end of said second connecting member being coupled to said second end of said first connecting member; and a third connecting member having a first end coupled to said annular body of said connecting structure and a second end spaced from said annular body of said connecting structure, said third connecting member having a thickness that is less than said third thickness of said annular body of said ring airfoil, said second end of said second connecting member being coupled to said second end of said first connecting member and said second end of said second connecting member.

2. A throwing toy as defined in claim 1 wherein said elongate tail portion comprises a tail member having a cross section that is circular in shape.

3. A throwing toy as defined in claim 1 wherein said elongate tail portion comprises a tail member that is cylindrical in shape.

4. A throwing toy, comprising:

a ring airfoil that is rotationally symmetric to facilitate spinning of said ring airfoil when said ring airfoil is thrown by a person, said ring airfoil comprising:

an annular body having a central axis and a diameter, said annular body being rotationally symmetric about said central axis, said annular body having a leading end, a trailing end spaced apart from said leading end in a direction parallel to said central axis, a non-planar annular outer surface, and an annular inner surface, said annular body having a first thickness at a point adjacent said leading end, a second thickness at a point adjacent said trailing end, and a third thickness at a point disposed between said leading end and said trailing end, said third thickness being greater than each of said first and second thicknesses, said annular body having a length corresponding to the distance between said leading end and said trailing end in a direction parallel to said central axis, said length of said annular body being at least as large as the width of a person's hand to allow a person to grip said annular body by the hand to throw said annular body, said annular inner surface having a diameter;

a front circular opening formed in said annular body, said front circular opening being formed at said leading end of said annular body, said front circular opening having a center that is located on said central axis of said annular body;

a rear circular opening formed in said annular body, said rear circular opening being formed at said trailing end of said annular body, said rear circular opening having a center that is located on said central axis; and a central passageway formed through said annular body, said central passageway having a central axis that is coincident with said central axis of said annular body, said central passageway interconnecting said front circular opening and said rear circular opening so that, when said annular body is thrown through the air, air flowing into said front circular opening passes through said central passageway and exits said central passageway through said rear circular opening, said central passageway having a diameter that is at least one-half of the diameter of said annular body of said ring airfoil;

an elongate tail portion coupled to said ring airfoil, said elongate tail portion having a leading end and a trailing end and a length corresponding to the distance between said leading end of said elongate tail portion and said trailing end of said elongate tail portion in a direction parallel to said central axis of said annular body, said length of said elongate tail portion being about at least as great as said length of said annular body of said ring airfoil;

at least three fins coupled to said elongate tail portion, said fins being spaced radially around said tail portion, each of said fins extending outwardly from said tail portion, at least a portion of each of said fins being disposed behind said annular body of said ring airfoil and outside of said central passageway; and a connecting structure that interconnects said elongate tail portion and said ring airfoil, at least a portion of said connecting structure being disposed within said central passageway of said annular body of said ring airfoil.

5. A throwing toy as defined in claim 4 wherein said connecting structure comprises an annular body having a front end, a back end, an outer annular surface and an inner annular surface, said outer annular surface of said annular body of said connecting structure having a diameter that corresponds to said diameter of said inner surface of said annular body of said ring airfoil, said annular body of said connecting structure having a length corresponding to the distance between said front end of said annular body of said connecting structure and said back end of said annular body of said connecting structure in a direction parallel to said central axis, said length of said annular body of said connecting structure being smaller than said length of said annular body of said ring airfoil.

6. A throwing toy as defined in claim 4 wherein said connecting structure comprises:

an annular body having a front end, a back end, an outer annular surface and an inner annular surface, said outer annular surface of said annular body of said connecting structure having a diameter that corresponds to said diameter of said inner surface of said annular body of said ring airfoil, said annular body of said connecting structure having a length corresponding to the distance between said front end of said annular body of said connecting structure and said back end of said annular body of said connecting structure in a direction parallel to said central axis, said length of said annular body of said connecting structure being smaller than said length of said annular body of said ring airfoil;

a first connecting member having a first end coupled to said annular body of said connecting structure and a second end spaced from said annular body of said connecting structure; and a second connecting member having a first end coupled to said annular body of said connecting structure and a second end spaced from said annular body of said connecting structure, said second end of said second connecting member being coupled to said second end of said first connecting member.

7. A throwing toy as defined in claim 4 wherein said elongate tail portion comprises a tail member having a cross section that is circular in shape.

8. A throwing toy as defined in claim 4 wherein said elongate tail portion comprises a tail member that is cylindrical in shape.

9. A throwing toy, comprising:

a ring airfoil that is rotationally symmetric to facilitate spinning of said ring airfoil when said ring airfoil is thrown by a person, said ring airfoil comprising:

an annular body having a central axis and a diameter, said annular body being rotationally symmetric about said central axis, said annular body having a leading end, a trailing end spaced apart from said leading end in a direction parallel to said central axis, an annular outer surface, and an annular inner surface, said annular body having a length corresponding to the distance between said leading end and said trailing end in a direction parallel to said central axis, said length of said annular body being at least as large as the width of a person's hand to allow a person to grip said annular body by the hand to throw said annular body, said annular inner surface having a diameter;

a front circular opening formed in said annular body, said front circular opening being formed at said leading end of said annular body, said front circular opening having a center that is located on said central axis of said annular body;

a rear circular opening formed in said annular body, said rear circular opening being formed at said trailing end of said annular body, said rear circular opening having a center that is located on said central axis; and a central passageway formed through said annular body, said central passageway having a central axis that is coincident with said central axis of said annular body, said central passageway interconnecting said front circular opening and said rear circular opening so that, when said annular body is thrown through the air, air flowing into said front circular opening passes through said central passageway and exits said central passageway through said rear circular opening, said central passageway having a diameter that is at least one-half of the diameter of said annular body of said ring airfoil;

an elongate tail portion coupled to said ring airfoil;

a plurality of fins coupled to said elongate tail portion, said fins being spaced radially around said tail portion, each of said fins extending outwardly from said tail portion, at least a portion of each of said fins being disposed behind said annular body of said ring airfoil and outside of said central passageway; and a connecting structure that interconnects said elongate tail portion and said ring airfoil, at least a portion of said connecting structure being disposed within said central passageway of said annular body of said ring airfoil.

10. A throwing toy as defined in claim 9 wherein said elongate tail portion has a leading end and a trailing end and a length corresponding to the distance between said leading end of said elongate tail portion and said trailing end of said elongate tail portion in a direction parallel to said central axis of said annular body, said length of said elongate tail portion being about at least as great as said length of said annular body of said ring airfoil.

11. A throwing toy as defined in claim 9 wherein said annular body has a first thickness at a point adjacent said leading end, a second thickness at a point adjacent said trailing end, and a third thickness at a point disposed between said leading end and said trailing end and wherein said third thickness is greater than each of said first and second thicknesses.

12. A throwing toy as defined in claim 9 wherein said connecting structure comprises an annular body having a front end, a back end, an outer annular surface and an inner annular surface, said outer annular surface of said annular body of said connecting structure having a diameter that corresponds to said diameter of said inner surface of said annular body of said ring airfoil, said annular body of said connecting structure having a length corresponding to the distance between said front end of said annular body of said connecting structure and said back end of said annular body of said connecting structure in a direction parallel to said central axis, said length of said annular body of said connecting structure being smaller than said length of said annular body of said ring airfoil.

13. A throwing toy as defined in claim 9 wherein said connecting structure comprises:

an annular body having a front end, a back end, an outer annular surface and an inner annular surface, said outer annular surface of said annular body of said connecting structure having a diameter that corresponds to said diameter of said inner surface of said annular body of said ring airfoil, said annular body of said connecting structure having a length corresponding to the distance between said front end of said annular body of said connecting structure and said back end of said annular body of said connecting structure in a direction parallel to said central axis, said length of said annular body of said connecting structure being smaller than said length of said annular body of said ring airfoil;

a first connecting member having a first end coupled to said annular body of said connecting structure and a second end spaced from said annular body of said connecting structure; and a second connecting member having a first end coupled to said annular body of said connecting structure and a second end spaced from said annular body of said connecting structure, said second end of said second connecting member being coupled to said second end of said first connecting member.

14. A throwing toy, comprising:

a ring airfoil that is rotationally symmetric to facilitate spinning of said ring airfoil when said ring airfoil is thrown by a person, said ring airfoil comprising:

an annular body having a central axis and a diameter, said annular body being rotationally symmetric about said central axis, said annular body having a leading end, a trailing end spaced apart from said leading end in a direction parallel to said central axis, an annular outer surface, and an annular inner surface, said annular body having a length corresponding to the distance between said leading end and said trailing end in a direction parallel to said central axis, said length of said annular body being at least as large as the width of a person's hand to allow a person to grip said annular body by the hand to throw said annular body, said annular inner surface having a diameter;

a front circular opening formed in said annular body, said front circular opening being formed at said leading end of said annular body, said front circular opening having a center that is located on said central axis of said annular body;

a rear circular opening formed in said annular body, said rear circular opening being formed at said trailing end of said annular body, said rear circular opening having a center that is located on said central axis; and a central passageway formed through said annular body, said central passageway having a central axis that is coincident with said central axis of said annular body, said central passageway interconnecting said front circular opening and said rear circular opening so that, when said annular body is thrown through the air, air flowing into said front circular opening passes through said central passageway and exits said central passageway through said rear circular opening;

an elongate tail portion coupled to said ring airfoil, said elongate tail portion having a length that is at least as great as said length of said annular body of said ring airfoil;

a plurality of fins coupled to said elongate tail portion, said fins being spaced radially around said tail portion, each of said fins extending outwardly from said tail portion, at least a portion of each of said fins being disposed behind said annular body of said ring airfoil and outside of said central passageway; and a connecting structure that interconnects said elongate tail portion and said ring airfoil.

15. A throwing toy as defined in claim 14 wherein said annular body of said ring airfoil has a first thickness at a point adjacent said leading end, a second thickness at a point adjacent said trailing end, and a third thickness at a point disposed between said leading end and said trailing end and wherein said third thickness is greater than each of said first and second thicknesses.

16. A throwing toy as defined in claim 14 wherein at least a portion of said connecting structure is disposed within said central passageway of said annular body of said ring airfoil.

17. A throwing toy as defined in claim 14 wherein said central passageway has a diameter that is at least one-half of said diameter of said annular body of said ring airfoil.

18. A throwing toy, comprising:

a ring airfoil that is rotationally symmetric to facilitate spinning of said ring airfoil when said ring airfoil is thrown by a person, said ring airfoil comprising:

an annular body having a central axis and a diameter, said annular body being rotationally symmetric about said central axis, said annular body having a leading end, a trailing end spaced apart from said leading end in a direction parallel to said central axis, an annular outer surface, and an annular inner surface, said annular body having a length that facilitates a person to grip said annular body by the hand to throw said annular body;

a front circular opening formed in said annular body, said front circular opening being formed at said leading end of said annular body, said front circular opening having a center that is located on said central axis of said annular body;

a rear circular opening formed in said annular body, said rear circular opening being formed at said trailing end of said annular body, said rear circular opening having a center that is located on said central axis; and a central passageway formed through said annular body, said central passageway having a central axis that is coincident with said central axis of said annular body, said central passageway interconnecting said front circular opening and said rear circular opening so that, when said annular body is thrown through the air, air flowing into said front circular opening passes through said central passageway and exits said central passageway through said rear circular opening;

a tail portion coupled to said ring airfoil; and a plurality of fins coupled to said tail portion, said fins being spaced radially around said tail portion, each of said fins extending outwardly from said tail portion, at least a portion of each of said fins being disposed behind said annular body of said ring airfoil and outside of said central passageway.

19. A throwing toy as defined in claim 18 wherein said annular body of said ring airfoil has a first thickness at a point adjacent said leading end, a second thickness at a point adjacent said trailing end, and a third thickness at a point disposed between said leading end and said trailing end and wherein said third thickness is greater than each of said first and second thicknesses.

20. A throwing toy as defined in claim 18 additionally comprising a connecting structure that interconnects said elongate tail portion and said ring airfoil, at least a portion of said connecting structure being disposed within said central passageway of said annular body of said ring airfoil.

21. A throwing toy as defined in claim 18 wherein said central passageway has a diameter that is at least one-half of said diameter of said annular body of said ring airfoil.

* * * * *